US009694256B2

(12) United States Patent
Myers et al.

(10) Patent No.: US 9,694,256 B2
(45) **Date of Patent: *Jul. 4, 2017**

(54) GOLF CLUB HEAD WITH ADJUSTABLE CENTER OF GRAVITY

(71) Applicant: CALLAWAY GOLF COMPANY, Carlsbad, CA (US)

(72) Inventors: Matthew Myers, Carlsbad, CA (US); Denver Holt, Carlsbad, CA (US); James A. Seluga, Carlsbad, CA (US); Wee Joung Kim, Vista, CA (US); Steven C. Sutton, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 29 days.

This patent is subject to a terminal disclaimer.

(21) Appl. No.: 14/995,550

(22) Filed: Jan. 14, 2016

(65) Prior Publication Data

US 2016/0129323 A1 May 12, 2016

Related U.S. Application Data

(63) Continuation of application No. 14/175,657, filed on Feb. 7, 2014, now Pat. No. 9,364,728, which is a continuation-in-part of application No. 14/174,068, filed on Feb. 6, 2014, which is a continuation-in-part of application No. 14/163,946, filed on Jan. 24, 2014, now Pat. No. 9,211,453, which is a (Continued)

(51) Int. Cl.
*A63B 53/04* (2015.01)
*A63B 53/06* (2015.01)

(52) U.S. Cl.
CPC .. *A63B 53/0466* (2013.01); *A63B 2053/0433* (2013.01); *A63B 2053/0491* (2013.01)

(58) Field of Classification Search
USPC ..... 473/324–350
See application file for complete search history.

(56) References Cited

U.S. PATENT DOCUMENTS 5,769,736 A * 6/1998 Sato ..... A63B 53/065 473/335
5,938,543 A * 8/1999 McGeeney ..... A63B 53/04 473/324

(Continued)

FOREIGN PATENT DOCUMENTS

JP 01043278 A * 2/1989
JP 06238022 A * 8/1994

(Continued)

*Primary Examiner* — Alvin Hunter
(74) *Attorney, Agent, or Firm* — Rebecca Hanovice; Michael Catania; Sonia Lari

(57) ABSTRACT

A golf club head comprising a slidable weight for adjusting the location of the golf club head center of gravity, as well as the golf club head bias, is disclosed herein. In particular, the golf club head, which may be a wood or iron-type head, comprises a pair of rails extending along at least one surface, such as a rear surface of an iron type head or a channel disposed in a wood-type head, and a slidable weight comprising a pair of grooves sized to receive the rails. In some embodiments, an applique or one or more clips are applied over or to the rails to prevent the weight from disengaging from the golf club head.

19 Claims, 4 Drawing Sheets

Related U.S. Application Data continuation-in-part of application No. 14/033,218, filed on Sep. 20, 2013, now Pat. No. 8,696,491, which is a continuation-in-part of application No. 13/923,571, filed on Jun. 21, 2013, now Pat. No. 9,084,921, which is a continuation-in-part of application No. 13/778,958, filed on Feb. 27, 2013, now Pat. No. 8,894,506, said application No. 14/163,946 is a continuation-in-part of application No. 13/766,658, filed on Feb. 13, 2013, now Pat. No. 8,790,195.

(60) Provisional application No. 61/905,749, filed on Nov. 18, 2013, provisional application No. 61/898,956, filed on Nov. 1, 2013, provisional application No. 61/893,728, filed on Oct. 21, 2013, provisional application No. 61/727,608, filed on Nov. 16, 2012, provisional application No. 61/746,348, filed on Dec. 27, 2012.

(56) References Cited

U.S. PATENT DOCUMENTS 7,147,573 B2 * 12/2006 DiMarco ..... A63B 53/0466 473/324
7,166,041 B2 * 1/2007 Evans ..... A63B 53/0466 473/334
7,452,286 B2 * 11/2008 Lin ..... A63B 53/0466 473/334
7,520,820 B2 * 4/2009 Dimarco ..... A63B 53/0466 473/334
7,775,905 B2 * 8/2010 Beach ..... A63B 53/0466 473/256
7,824,280 B2 * 11/2010 Yokota ..... A63B 53/0466 473/334
8,016,694 B2 * 9/2011 Llewellyn ..... A63B 53/0466 473/334
8,192,303 B2 * 6/2012 Ban ..... A63B 53/0466 473/335
8,202,175 B2 * 6/2012 Ban ..... A63B 53/0466 473/334
8,444,505 B2 * 5/2013 Beach ..... A63B 53/0466 473/334
8,696,491 B1 * 4/2014 Myers ..... A63B 53/06 473/334
8,790,195 B1 * 7/2014 Myers ..... A63B 53/0466 473/335
8,894,506 B1 * 11/2014 Myers ..... A63B 53/0466 473/334
8,968,116 B1 * 3/2015 Myers ..... A63B 53/0466 473/334
9,061,186 B2 * 6/2015 Larson ..... A63B 53/047
9,108,090 B2 * 8/2015 Stites ..... A63B 53/0466
9,174,096 B2 * 11/2015 Sargent ..... A63B 53/0466
9,180,349 B1 * 11/2015 Seluga ..... A63B 53/04
9,211,453 B1 * 12/2015 Foster ..... A63B 53/06
9,216,332 B1 * 12/2015 Ehlers ..... A63B 53/06
9,238,162 B2 * 1/2016 Breier ..... A63B 53/0466
9,259,625 B2 * 2/2016 Sargent ..... A63B 53/0466
9,364,728 B1 * 6/2016 Myers ..... A63B 53/06
2006/0178228 A1 * 8/2006 DiMarco ..... A63B 53/0466 473/334
2006/0240908 A1 * 10/2006 Adams ..... A63B 53/0466 473/334
2007/0265108 A1 * 11/2007 Lin ..... A63B 53/0466 473/334
2008/0020861 A1 * 1/2008 Adams ..... A63B 53/04 473/334
2010/0075773 A1 * 3/2010 Casati, Jr. ..... A63B 49/02 473/334
2010/0234130 A1 * 9/2010 Tavares ..... A63B 53/047 473/332
2010/0292027 A1 * 11/2010 Beach ..... A63B 53/0466 473/334
2011/0053705 A1 * 3/2011 Stites ..... A63B 53/0466 473/334
2015/0306473 A1 * 10/2015 Breier ..... A63B 53/0466 473/336
2015/0321055 A1 * 11/2015 Golden ..... A63B 53/0466 473/338

FOREIGN PATENT DOCUMENTS

JP 07231957 A * 9/1995
JP 10137374 A * 5/1998
JP 2002219197 A * 8/2002
JP 2003169870 A * 6/2003
JP 2003236025 A * 8/2003
JP 2004081241 A * 3/2004
JP 2005296582 A * 10/2005
JP 2005323978 A * 11/2005
JP 2006187489 A * 7/2006
JP 2006239154 A * 9/2006
JP 2006320493 A * 11/2006
JP 2007267777 A * 10/2007
JP 2008194454 A * 8/2008 ..... A63B 53/0466
JP 2010252964 A * 11/2010
JP 2011005011 A * 1/2011 ..... A63B 53/0466
JP 2011005167 A * 1/2011 ..... A63B 53/0466
JP 2011010722 A * 1/2011
JP 2012192179 A * 10/2012 ..... A63B 53/04

* cited by examiner

GOLF CLUB HEAD WITH ADJUSTABLE CENTER OF GRAVITY

CROSS REFERENCES TO RELATED APPLICATIONS

The present application is a continuation of U.S. patent application Ser. No. 14/175,657, filed on Feb. 7, 2014, which claims priority to U.S. Provisional Patent Application Nos. 61/905,749, filed on Nov. 18, 2013, 61/898,956, filed on Nov. 1, 2013, and 61/893,728, filed on Oct. 21, 2013, and is a continuation-in-part of U.S. patent application Ser. No. 14/174,068, filed on Feb. 6, 2014, which is a continuation-in-part of U.S. patent application Ser. No. 14/163,946, filed on Jan. 24, 2014, and issued on Dec. 15, 2015, as U.S. Pat. No. 9,211,453, which is a continuation-in-part of U.S. patent application Ser. No. 14/033,218, filed on Sep. 20, 2013, and issued on Apr. 15, 2014, as U.S. Pat. No. 8,696,491, which is a continuation-in-part of U.S. patent application Ser. No. 13/923,571, filed on Jun. 21, 2013, and issued on Jul. 21, 2015, as U.S. Pat. No. 9,084,921, which is a continuation-in-part of U.S. patent application Ser. No. 13/778,958, filed on Feb. 27, 2013, and issued on Nov. 25, 2014, as U.S. Pat. No. 8,894,506, which claims priority to U.S. Provisional Patent Application No. 61/727,608, filed on Nov. 16, 2012, the disclosure of each of which is hereby incorporated by reference in its entirety herein. U.S. patent application Ser. No. 14/163,946 also is a continuation-in-part of U.S. patent application Ser. No. 13/766,658, filed on Feb. 13, 2013, and issued on Jul. 29, 2014, as U.S. Pat. No. 8,790,195, which claims priority to U.S. Provisional Patent Application No. 61/746,348, filed on Dec. 27, 2012, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to a weight for a golf club head that can be adjusted along one or more channels.

Description of the Related Art

The ability to adjust center of gravity location and weight in the head of driving clubs is useful for controlling performance of the golf club. The prior art includes several different solutions for adjustable weighting, but these solutions do not optimize weight adjustment. There is a need for a weighting mechanism that allows for simple and flexible center of gravity (CG) and moment of inertia (MOI) adjustability.

BRIEF SUMMARY OF THE INVENTION

The present invention presents a novel way of working with adjustable products. The present invention allows consumers to easily move and fix a weight at any location within one or more channels disposed in the golf club head in such a way to maximize aesthetic appearances while preserving the function of the movable weight. The objective of this invention is to provide an adjustable weight with minimal or no effect on appearance at address while maximizing the ability of the weight to adjust center of gravity height. Additional goals include minimizing the fixed component of the structure dedicated to the weighting system and also minimizing any potential effect on impact sound. Yet another object of the present invention is an adjustable weighting feature for lateral or vertical center of gravity control which is placed to maximize effectiveness and may be entirely concealed from view at address.

One aspect of the present invention is a golf club head comprising a face component, a body comprising a crown, a sole, a heel side, a toe side, and an edge portion where the crown makes contact with the sole, and a weight comprising a pair of grooves, wherein the sole comprises a channel, wherein the channel comprises a pair of protruding rails extending parallel to one another, and wherein the grooves are sized to receive the rails. The channel may extend along at least a part of the edge portion, and the weight may comprise a mass of 2 to 10 grams. In some embodiments, the golf club head may further comprise a screw, which may reversibly fix the weight to the rails.

In other embodiments, the golf club head may further comprise an applique sized to cover the channel. The applique may comprise a cutout, and the weight may be visible through the cutout when the applique is affixed to the golf club head. In some embodiments, the cutout may be filled with a transparent or translucent material. In some embodiments, the applique may composed of a lightweight material selected from the group consisting of plastic, rubber, composite, and aluminum alloy. In some embodiments, the channel may comprise a pocket region, and the applique may fill the pocket region. In a further embodiment, the applique may comprise a cutout, and the cutout may not extend over the pocket region.

In some embodiments, the face component and the sole may be composed of a metal material, and the crown may be composed of a non-metal material, such as a composite material. In other embodiments, the golf club head may further comprise an adjustable hosel. The golf club head of the present invention may be selected from the group consisting of a driver-type head, a fairway wood-type head, and a hybrid-type head.

Another aspect of the present invention is an iron-type golf club head comprising a body comprising a face, a top surface, a bottom surface, a hosel, a rear surface, a toe side, and a heel side, a pair of parallel rails, and a weight comprising a pair of grooves sized to receive the rails, wherein the pair of parallel rails is disposed on the rear surface. In some embodiments, the pair of parallel rails may extend from the heel side to the toe side. In another embodiment, the iron-type golf club head may further comprise a screw, which may reversibly fix the weight to the rails. In another embodiment, the iron-type golf club head may further comprise an applique or at least one clip, which may reversibly fix the weight to the rails. In a further embodiment, the hosel may comprise an adjustable structure. In another embodiment, the weight may have a mass of 2 to 10 grams.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The design approaches described herein are based on a construction used in a driver head characterized by a composite crown adhesively bonded to a cast titanium body. This particular construction approach permits the crown configuration to be adapted to the inventive weighting scheme with minimal impact on weight and function. However, the weighting embodiments disclosed herein can be used with other constructions, including all titanium, all composite, and a composite body with metal face cup. The embodiments may also work in conjunction with at least one adjustable weight port on the club head. Shifting weight along the channel described herein allows for control of center of gravity location.

Figure 1:
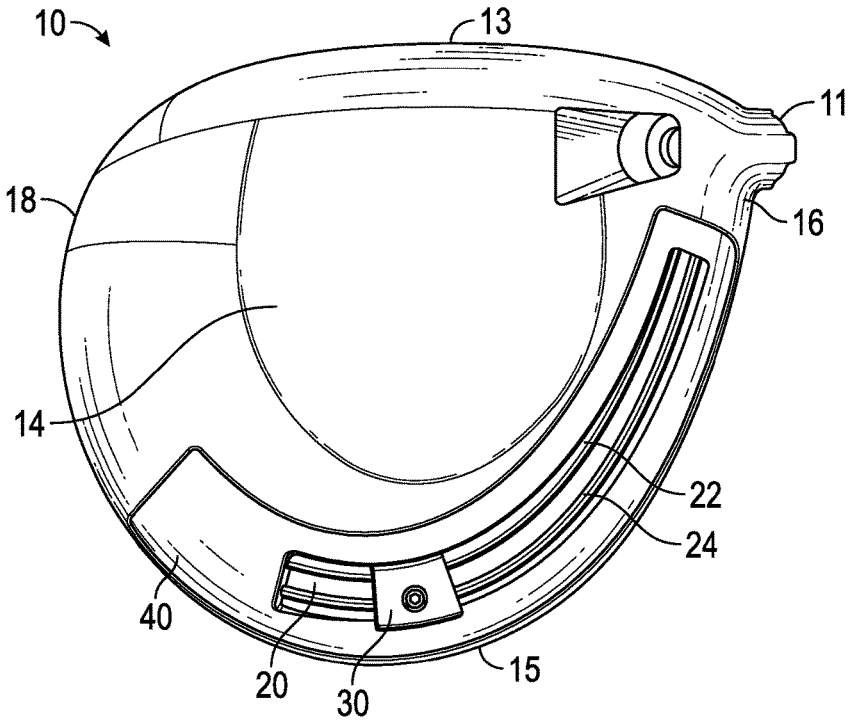
FIG. 1 is a sole plan view of a first embodiment of the present invention.
Figure 2:
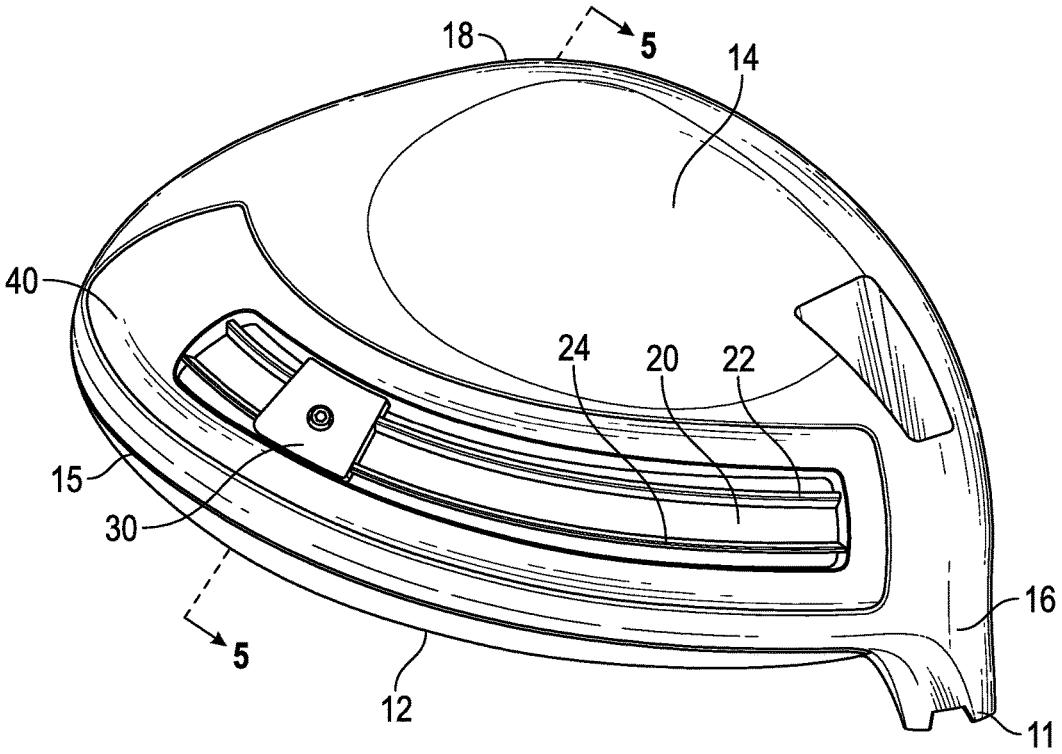
FIG. 2 is a rear perspective view of the embodiment shown in FIG. 1.
Figure 3:
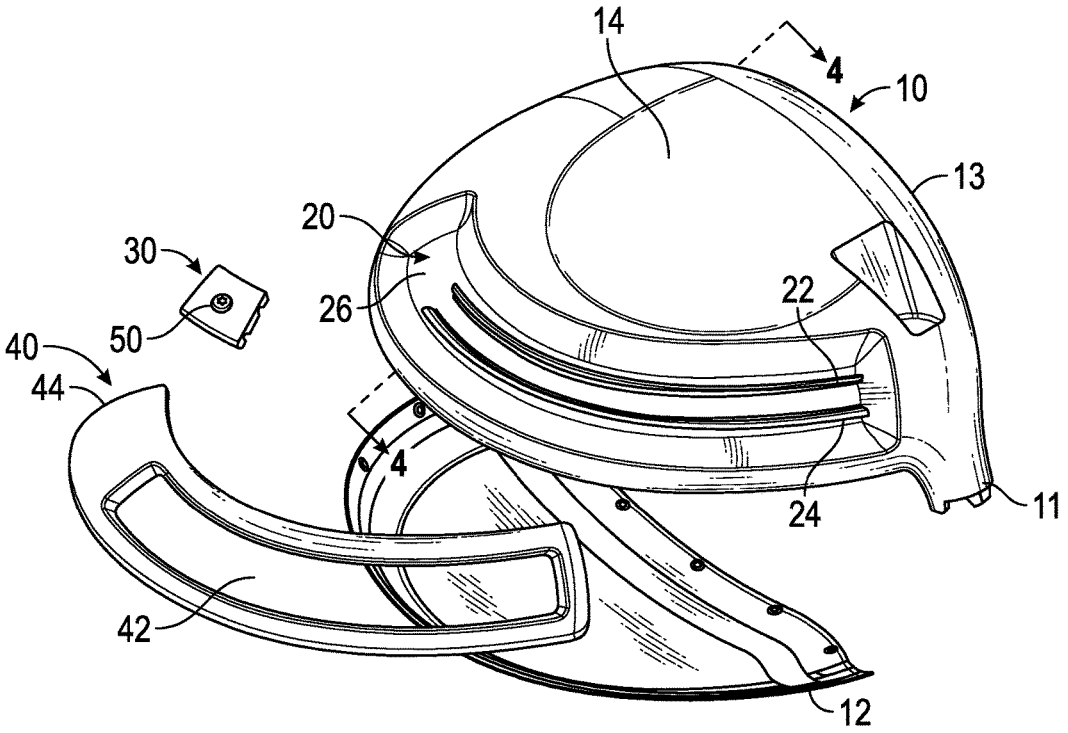
FIG. 3 is an exploded view of the embodiment shown in FIG. 1.
Figure 4:
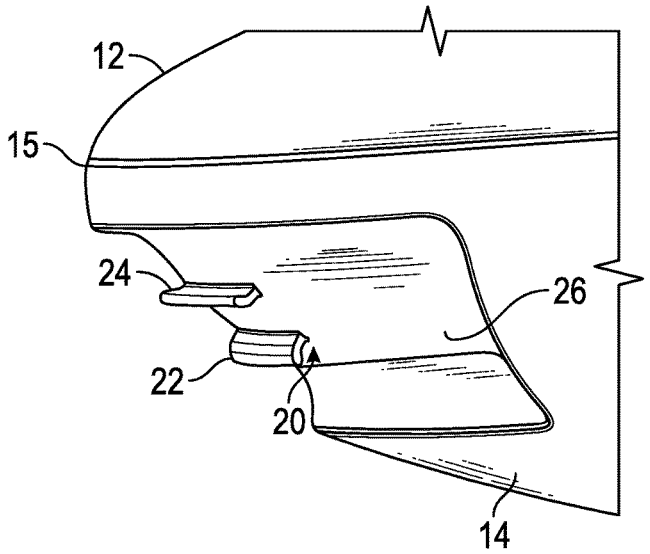
FIG. 4 is a cross-sectional view of the embodiment shown in FIG. 3 along lines 4-4.
Figure 5:
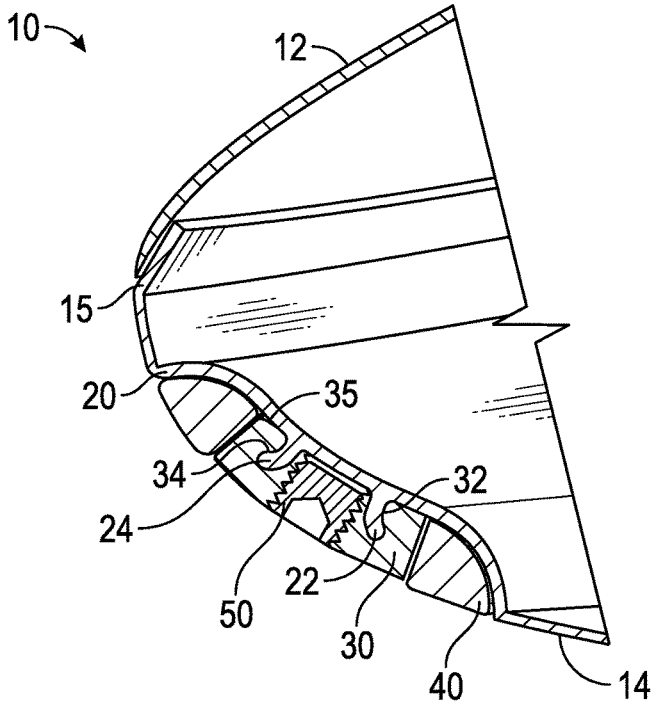
FIG. 5 is a cross-sectional view of the embodiment shown in FIG. 2 along lines 5-5.

A first, preferred embodiment of the present invention is shown in FIGS. 1-5. The golf club head 10, which preferably is a driver or a large fairway wood, comprises a channel 20 disposed within the sole 14 of the golf club head, though in alternative embodiments the channel 20 may be disposed in a ribbon or skirt portion or in the crown 12 of the golf club head 10. The channel 20 extends from a heel side 16 of the club head proximate a hosel 11, which preferably has an adjustable construction, towards a toe side 18 of the golf club head 10 proximate the edge portion 15, which is where the sole 14 and the crown 12 connect with one another. The channel 20 includes a pair of rails 22, 24 that extend along the length of the channel 20 parallel to one another, and which are received by a pair of grooves 32, 34 disposed in the bottom surface 35 of a slidable weight 30. As shown in FIGS. 4 and 5, the grooves 32, 34 and rails 22, 24 are shaped to mate so that the rails 22, 24 must be slid out of the grooves 32, 34 horizontally in order for the weight 30 to disengage from the rails 22, 24. This configuration prevents the weight 30 from falling out of the channel 20 if the golf club head 10 is turned upside down or shaken. The rails 22, 24 do not extend along the entire length of the channel 20, but instead terminate within the channel 20 so that a pocket 26 is formed, which is left open to allow the weight 30 to be inserted into the channel 20 and onto the rails 22, 24, as shown in FIG. 4.

Once the weight 30 has been moved to a desired location on the rails 22, 24 within the channel 20, the weight 30 is semi-permanently fixed in place with a screw 50, which presses the weight 30 against the rails 22, 24 or a plate (not shown), and/or functions as described in U.S. Provisional Patent Application Nos. 61/893,728 and 61/898,956, the disclosure of each of which is hereby incorporated by reference in its entirety herein. The weight 30 is further prevented from disengaging from the golf club head 10 by the addition of an applique 40, as shown in FIGS. 1-3 and 5. The applique 40 covers the channel 20 to prevent debris from entering the channel 20 while the golf club head 10 is in use, and hides the tooling marks created in the channel 20 when it is cast into the sole 14 or other metal part of the golf club head 10. The applique 40 preferably comprises a cutout portion 42, which permits the location of the weight 30 to be visible to a user once it is fixed in place within the channel 20, and a closed portion 44, which fills and/or blocks the pocket 26 and prevents the weight 30 from becoming disengaged from the channel 20. The cutout portion 42 preferably is filled with a transparent or translucent material, such as plastic or high-strength glass. The applique 40 preferably is composed of a lightweight material, such as plastic, rubber, composite, or a lightweight metal alloy such as an aluminum alloy, and may include decorative features such as images, texturing, and/or coloring.

Figure 6:
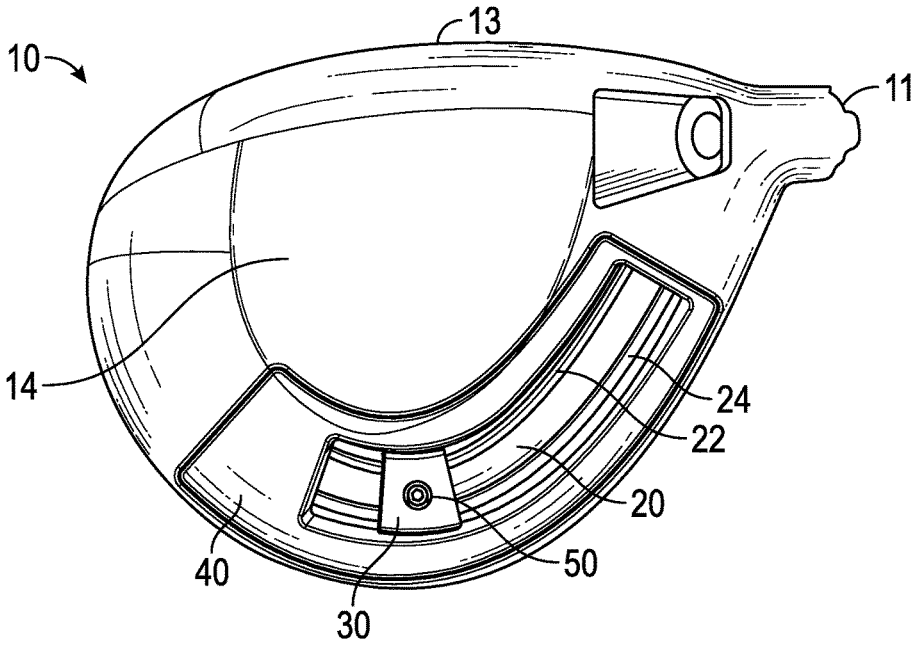
FIG. 6 is a sole plan view of a second embodiment of the present invention.
Figure 7:
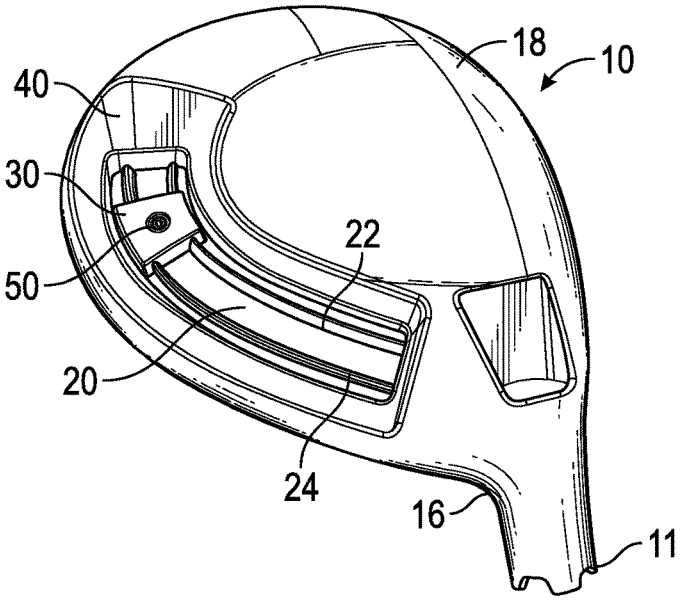
FIG. 7 is a rear perspective view of the embodiment shown in FIG. 6.
Figure 8:
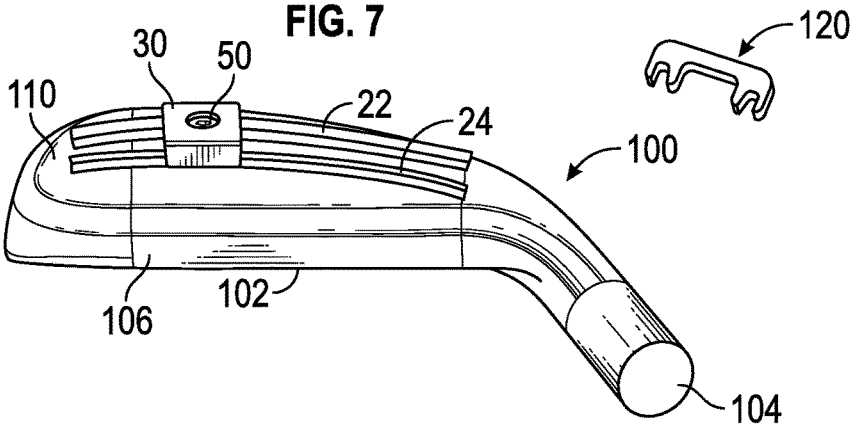
FIG. 8 is a top perspective view of a third embodiment of the present invention.
Figure 9:
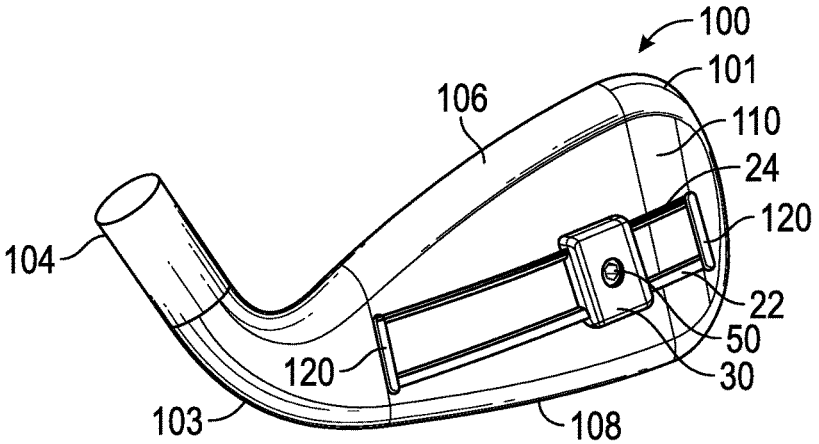
FIG. 9 is a rear perspective view of the embodiment shown in FIG. 8.

As shown in FIGS. 6 and 7, the configuration disclosed in FIGS. 1-5 can also be used in connection with a standard-sized fairway wood. In yet another embodiment, shown in FIGS. 8 and 9, the adjustable weight configuration can be used in connection with an iron-type golf club head 100. In this configuration, the head 100 comprises a face 102, hosel 104, top surface 106, bottom surface 108, and rear surface 110, but does not necessarily comprise a channel 20 (though it may, in an alternative embodiment). Instead, the parallel rails 22, 24 are disposed directly on the rear surface 110 and extend from a toe side 101 to a heel side 103 of the golf club head 100. The weight 30 is affixed to the rails 22, 24 and adjusted and fixed to the golf club head 10 in the same manner as disclosed above. An applique 40 optionally may be applied to the rear surface 110 of the golf club head 100 to improve the aesthetic appeal of the golf club head 100 and to prevent the weight 30 from disengaging from the rails 22, 24, but is not necessary because there is no channel 20 to cover. In another embodiment, one or more clips 120 having grooves sized to receive each rail 22, 24 may be permanently or semi-permanently affixed to the ends of the rails 22, 24, to prevent the weight 30 from disengaging therefrom.

The channels 20 disclosed herein may have any of the configurations disclosed in U.S. patent application Ser. No. 13/656,271, the disclosure of which is hereby incorporated by reference in its entirety herein, and any of the channel 20 embodiments disclosed herein may disposed anywhere on a golf club head 10, including the sole, 14, crown 12, face, 13, and/or ribbon portions. Similarly, the rails 22, 24 may also be disposed anywhere on the golf club head 10, and may extend from one portion of the golf club head 10 to another. The adjustable weighting configurations shown herein may be used with any type of golf club, including woods, irons, hybrids, and putters.

In the first and second embodiments disclosed herein, the face 13 and sole 14 of the golf club head 10 preferably are formed from a metal material, while the crown 12 is formed from a non-metal material such as composite. In other embodiments, the golf club head 10 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising:
a face component;
a body comprising a channel;
an applique sized to cover the channel; and
a weight comprising a pair of grooves,
wherein the channel comprises a pair of protruding rails extending parallel to one another,
wherein the grooves are sized to receive at least a portion of the rails
wherein the channel comprises a pocket region, and
wherein the applique fills the pocket region.

2. The golf club head of claim 1, wherein the weight comprises a mass of 2 to 10 grams.

3. The golf club head of claim 1, further comprising a screw, wherein the screw reversibly fixes the weight to the rails.

4. The golf club head of claim 1, wherein the applique comprises a cutout, and wherein the weight is visible through the cutout when the applique is affixed to the golf club head.

5. The golf club head of claim 4, wherein the cutout is filled with a translucent material.

6. The golf club head of claim 5, wherein the applique is composed of a lightweight material selected from the group consisting of plastic, rubber, composite, and aluminum alloy.

7. The golf club head of claim 1, wherein the applique comprises a cutout, and wherein the cutout does not extend over the pocket region when the applique is affixed to the golf club.

8. The golf club head of claim 1, further comprising an adjustable hosel.

9. The golf club head of claim 1, wherein the golf club head is selected from the group consisting of a driver-type head, a fairway wood-type head, and a hybrid-type head.

10. The golf club head of claim 9, wherein the golf club head is a driver-type head, wherein the body comprises a composite crown, a metal sole, an adjustable hosel, a heel side, and a toe side, and wherein the channel is disposed in the sole and extends from the heel side to the toe side.

11. The golf club head of claim 1, wherein channel has a first length, wherein each of the pair of rails has a second length, and wherein the first length is greater than the second length.

12. A golf club head comprising:
a face component;
a body comprising a pair of parallel rails;
at least one clip sized to receive the pair of rails;
at least one screw; and
a weight comprising a pair of grooves,
wherein the grooves are sized to receive at least a portion of the rails,
wherein the screw reversibly fixes the weight to the rails, and
wherein the at least one clip prevents the weight from disengaging from the rails.

13. The golf club head of claim 12, wherein the at least one clip comprises first and second clips.

14. The golf club head of claim 12, wherein the body comprises a hosel having an adjustable structure.

15. The golf club head of claim 12, wherein the body comprises a top surface, a bottom surface, and a rear surface, and wherein the pair of parallel rails is disposed on the rear surface.

16. The golf club head of claim 15, further comprising an applique, wherein the applique comprises a cutout portion, and wherein the weight is visible through the cutout portion when the applique is engaged with the body.

17. The golf club head of claim 16, wherein the applique is composed of a material selected from the group consisting of plastic, rubber, and composite.

18. The golf club head of claim 16, wherein the cutout portion is filled with a material selected from the group consisting of plastic and glass.

19. The golf club head of claim 12, wherein the weight has a mass of 2 to 10 grams.

* * * * *